United States Patent [19]

Kafai

[11] Patent Number: 5,003,655

[45] Date of Patent: Apr. 2, 1991

[54] BED SHEET ASSEMBLY

[76] Inventor: Malakeh B. Kafai, 17248 Van Gogh St., Granada Hills, Calif. 91344

[21] Appl. No.: 480,812

[22] Filed: Feb. 16, 1990

[51] Int. Cl.[5] ..... A47G 9/04

[52] U.S. Cl. ..... 5/496; 5/494; 5/484; 5/497

[58] Field of Search ..... 5/496, 498, 497, 495, 5/493, 482, 500, 502

[56] References Cited

U.S. PATENT DOCUMENTS

| | | | |
|---|---|---|---|
| 2,789,292 | 4/1957 | Budinquest | 5/496 |
| 3,066,321 | 12/1962 | Kintner . | |
| 3,179,958 | 4/1965 | Capris | 5/496 |
| 3,570,026 | 3/1971 | Allison | 5/496 |
| 3,965,504 | 6/1976 | Ainsworth . | |
| 3,999,233 | 12/1976 | Morris | 5/493 |
| 4,040,133 | 8/1977 | Gilreath | 5/451 |
| 4,301,561 | 11/1981 | McLeod | 5/496 |
| 4,546,508 | 10/1985 | Ison | 5/494 |
| 4,646,375 | 3/1987 | Parker | 5/498 |
| 4,825,489 | 5/1989 | Ross | 5/497 |
| 4,899,407 | 2/1990 | McCue | 5/508 |
| 4,899,408 | 2/1990 | Illingworm | 5/496 |

*Primary Examiner*—Alexander Grosz
*Attorney, Agent, or Firm*—Louis L. Dachs

[57] ABSTRACT

The invention is a bed sheet assemby for a mattress and, in particular, for a rectangular mattress. In detail, the invention includes a fitted peripheral edge cover having side and end panels for covering the sides and ends, respectively of a mattress. The adjacent ends of the side and end panel are connected together to form vertical corners. The side and end panels each have upper and lower edge portions extending inward for extending about the peripheral edges of the top and bottom surfaces of the mattress when installed thereon. A sheet is adapted to overlay the mattress covering the top edge portion. A fastener system is provided for removably attaching the sheet to the cover.

7 Claims, 2 Drawing Sheets

FIG. 1
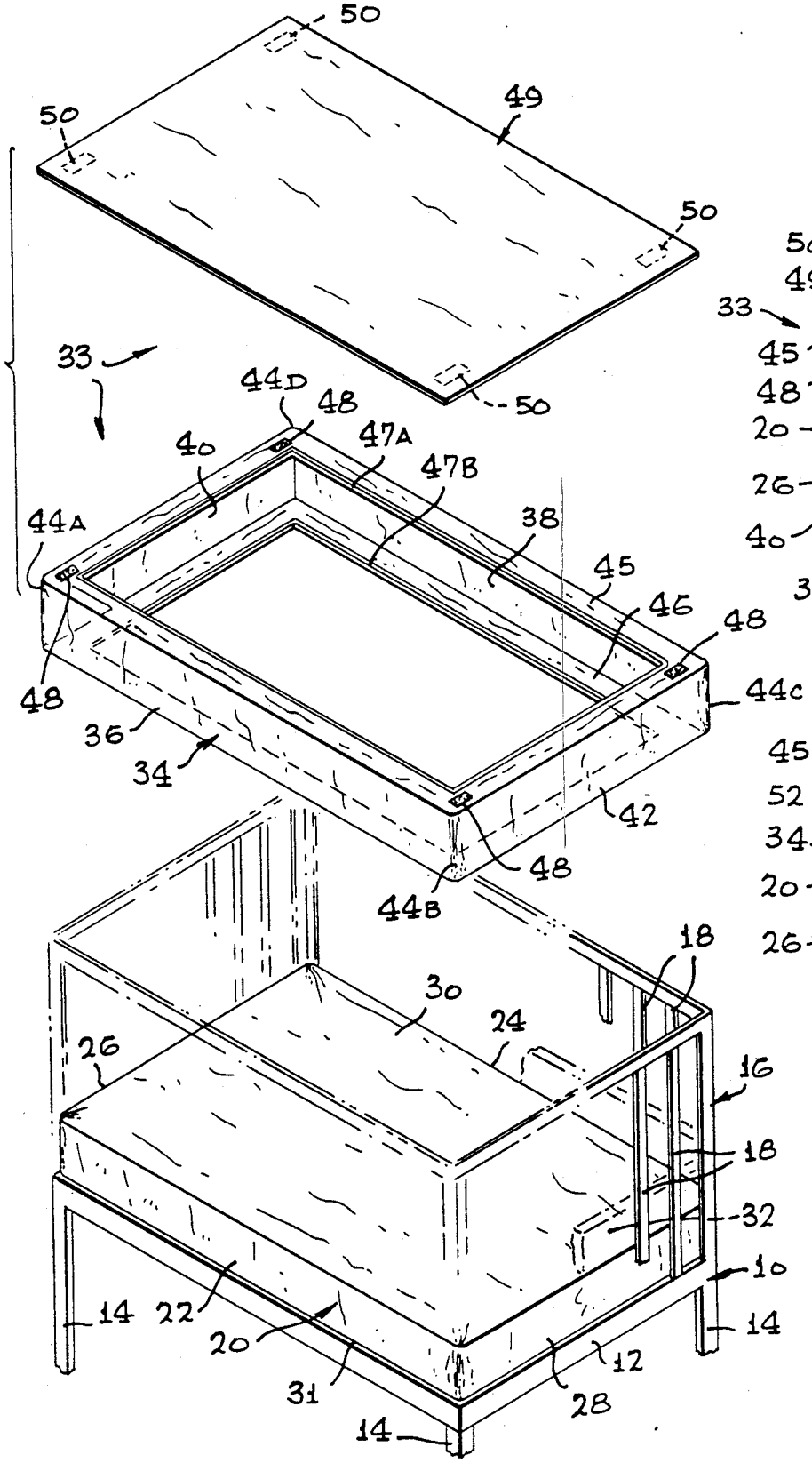
FIG. 3
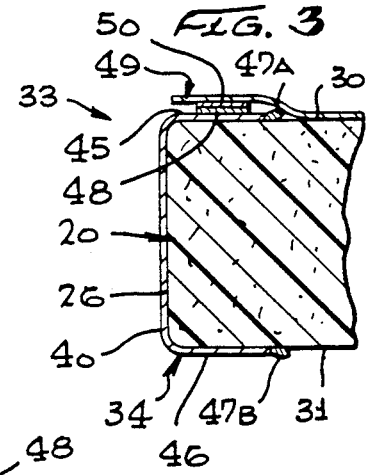
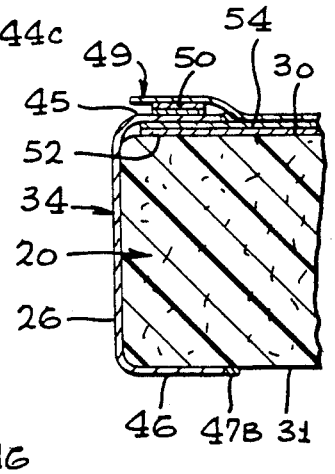
FIG. 4

BED SHEET ASSEMBLY

BACKGROUND OF THE INVENTION

1. Field of the Invention

The invention relates to an improved bed sheet assembly that is particularly useful in connection with baby cribs.

2. Description of Related Art

A common problem with conventional sheets for beds is that they just do not stay tucked in, often requiring the bed to be remade after each night's sleep. This problem was solved with the use of fitted sheets some of which use elastic bands which extend diagonally between the corners of the sheets at the underside of the mattress to aide in the maintenance of the sheet on the mattress. For example, U.S. Pat. No. 4,825,489 "Fitted Sheet" by Anthony J. Ross discloses such a fitted sheet. The fitted sheet comprises top, side and end panels for covering the top, sides and ends of a mattress with adjacent ends of the side and end panels connected together to form vertical corners. The lower portions of the side and end panels extend into an underlying relation with the underside of the mattress. Elastic corner bands are attached to each side panel at a location spaced from one end panel and are otherwise attached to the same end panel to extend diagonally therebetween, and a cross band is attached to the lower edges of the side panels at a location adjacent the point of attachment of the corner bands thereto.

Another example of a method of securing seats to a mattress can be found in U.S. Pat. No. 4,040,133 "Bedding Attachment System" by M. B. Gilreath. A section of hook and loop type fastener half is positioned on the edge of a waterbed mattress adjacent each corner. The hook and loop type fastener half is either connected directly to the mattress or attached to a strip of material that extends beneath the mattress and is secured there by the weight of the mattress. This hook and loop type fastener half is attached to a mating hook and loop type fastener half formed on a mattress pad and/or a lower sheet. An upper sheet is similarly provided with hook and loop type fastener halves to engage with mating hook and loop type fastener halves on the lower sheet. Also, of interest is U.S. Pat. No. 4,646,375 "Bed Sheet Fastener" by R. W. Parker. Here a hook and loop type fastener half is mounted to the corners of the bed frame. Each corner of the sheet incorporates an opened end pocket having a mating hook and loop type fastener half. In operation, the user inserts his or her hand into the pocket through the open end and guides the fastener halves into a mating relationship.

While the above bedding arrangements all provide methods of securing sheets to a mattress they require access to the underside of the mattress for installation of the sheet every time the bed linen is changed. In the primary application of the instant invention, i.e., for baby beds and cribs this creates problems. Babies wet the bed and, thus, bed sheets must be changed quite often and changing conventional or fitted sheets adds alot of work. If the mattress is in a baby crib, this task is even more difficult and time consuming. The typical baby crib utilizes a plurality of vertical bars extending about the mattress to secure the baby therewithin while still allowing the baby to be viewed. Additionally, quite often a bumper, a vertical pad, is installed above and around the periphery of the mattress to protect the baby's head. Thus, when changing the bottom sheet you must reach down between the bars/bumper and the mattress and pull the fitted sheet out over the corner of the mattress. It is even more difficult to install a clean sheet. Often, the mattress must be "man handled" to its side in order to replace the bottom sheet.

Also of interest is U.S. Pat. No. 4,301,561 "Separable, Fitted Liner and Bed Sheet for Waterbeds" by Margaret McLeod. Here, a sheet and liner for waterbeds and the like is provided for use in cooperation with a mattress pad wherein the liner has inner and outer connective strips along its peripheral edge. The mattress pad is provided with a connective strip for attachment to the inner strip on the liner while the sheet is provided with a connective strip for attachment to the outer strip on the liner. A second sheet may be connected to the first sheet along a selected edge thereof. While the underside of the mattress need not be reached to install sheets, joining at the sides still presents access problems when the mattress is installed in a crib. Additionally, with the liners and sheet all connected to each other it is possible to separate the top and bottom liners from each other when removing the sheet.

U.S. Pat. No. 4,546,508 "Bedding Assembly" by Deborah K. Ison a bottom sheet is attached to a mattress by means of a peripheral zipper. The top sheet is also attached to the bottom sheet also by means of a peripheral zipper. A blanket is secured to the edges of the top sheet by means of discrete fastening elements such as hooked fabric. The disadvantage of this design is that the use of peripheral zippers is expensive and in the targeted application, baby cribs, access to the peripheral portions of the mattress is restricted. In addition, zippers are prone to jam. U.S. Pat. No. 3,066,321 "Bedding Retaining Means" by Mildred Kintner discloses a mattress having a VELCRO hook and loop type fastener means along the peripheral edge of its top surface to which can be joined a mattress pad. While this allows the mattress pad to be removed with relative ease, and without requiring access to the sides or the underside of the mattress, the use of a VELCRO hook and loop type fastener in such a manner presents problems. The major problem is that the fastener means will wear out a lot sooner than the mattress requiring periodic removal of the worn VELCRO hook and loop type fasteners. This may or may not be easily accomplished.

In U.S. Pat. No. 3,965,504 "Bedding Assembly" by Phillis Ainsworth some of the above problems are eliminated. Here, the bed pad is secured to the mattress by means of flexible looped straps at the corners of the pad which hook around the corners of the mattress. A plurality of VELCRO hook and loop type fastener halves are mounted along the periphery of the pad. A U-shaped sheet is provided wherein one leg is a bottom sheet and the second leg is the top ,sheet with the bottom sheet incorporating VELCRO hook and loop type fastener halves which mate with those on the bed pad. A blanket and bedspread are similarly attached by means of VELCRO hook and loop type fasteners. While this design allows the removal of the top and bottom sheet from the top side of the mattress it does not meet all the requirements for use in a bed for babies. Because babies wet the bed often, not only must a waterproof sheet or pad be provided between the mattress and bottom sheet, it should also be easily removed. This cannot be accomplished using the Ainsworth assembly in that it is the bed pad that is attached to the mattress.

Thus, it is a primary object of the subject invention to provide a bed sheet assembly wherein the bottom sheet can be removed without requiring access to the side or underside of the mattress.

It is another primary object of the subject invention to provide a bed sheet assembly wherein the bed pad and/or a waterproof pad can be installed on the mattress and retained thereon requiring access only from the top of the mattress.

It a further object of the subject invention to provide a bed sheet assembly wherein the bottom sheet and the mattress pad or waterproof pad can be removed with little effort.

It is a still further object of the subject invention to provide a bed sheet assembly wherein the means to secure the bottom sheet and/or the mattress pad and/or the waterproof pad can be easily removed from the mattress.

SUMMARY OF THE INVENTION

The invention is a bed sheet assembly for covering a mattress and, in particular, a rectangular mattress. In detail, the invention comprises a fitted peripheral mattress edge cover having side and end panels for covering the sides and ends, respectively, of the mattress. The adjacent ends of the sides and end panels are connected together to form vertical corners. The side and end panels each further have upper and lower edge portions extending inward such that the cover has a "C" shaped cross-section, the edges for extending about the peripheral edges of the top and bottom surfaces of the mattress when the cover is installed thereon. Additionally, the cover can optionally incorporate an integral bed pad attached to the upper edge portion.

A sheet is included having an area equal to that of the mattress. Additionally, means are provided to removably attach the sheet to the mattress edge cover. Preferably the means are VELCRO hook and loop type fastener halves coupled to the top edge of the cover in proximity to the corners thereof and mating VELCRO hook and loop type fastener halves mounted on the corners of sheet. Preferably, the inner ends of the upper and lower edge portions incorporated elastic material such that the edge portions can be stretched over the mattress upon installation providing a good fit about the periphery thereof.

Additionally, VELCRO hook and loop type fastener halves can be mounted to the bottom edge portion of the cover near the corners at one end. A top sheet having one end with mating VELCRO hook and loop type fastener halves can be installed over the existing sheet and folded under the mattress so that the VELCRO hook and loop type fastener halves become mated securing the top sheet to the "foot end" of the mattress.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1, is a partial exploded perspective view of a baby crib including a mattress and the bed sheet assembly.

Illustrated in FIG. 2, is a perspective view of the mattress with the bed sheet assembly mounted thereon.

Figure 2:
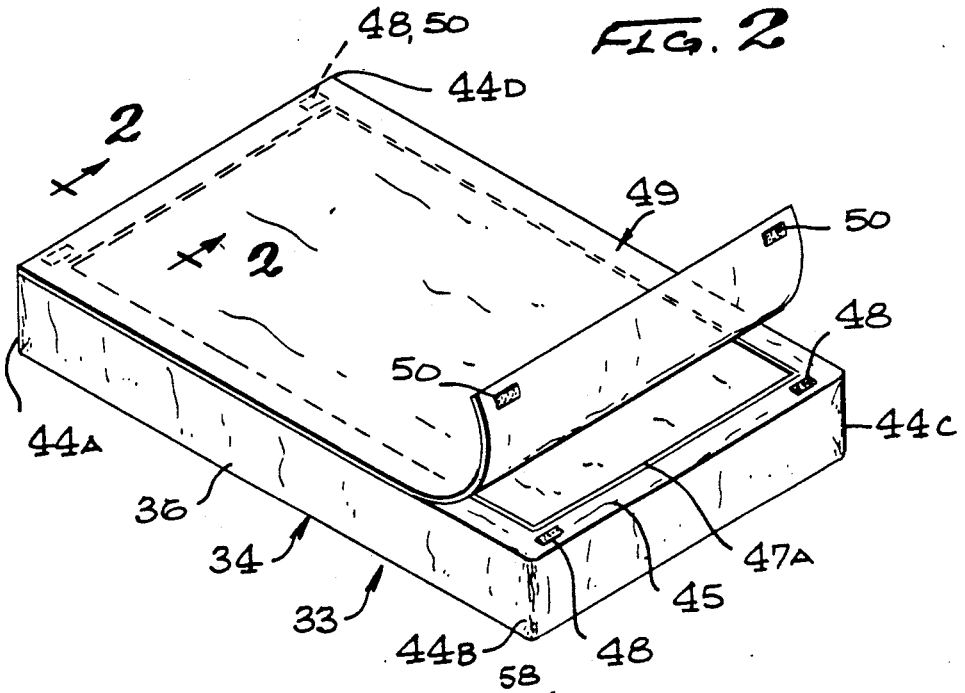

Illustrated in FIG. 3, is a partial cross-sectional view of FIG. 2, taken along the line 3—3.

Illustrated in FIG. 4, is a view similar to FIG. 3, illustrating the addition of a water impregnable sheet and mattress pad.

Figure 5:
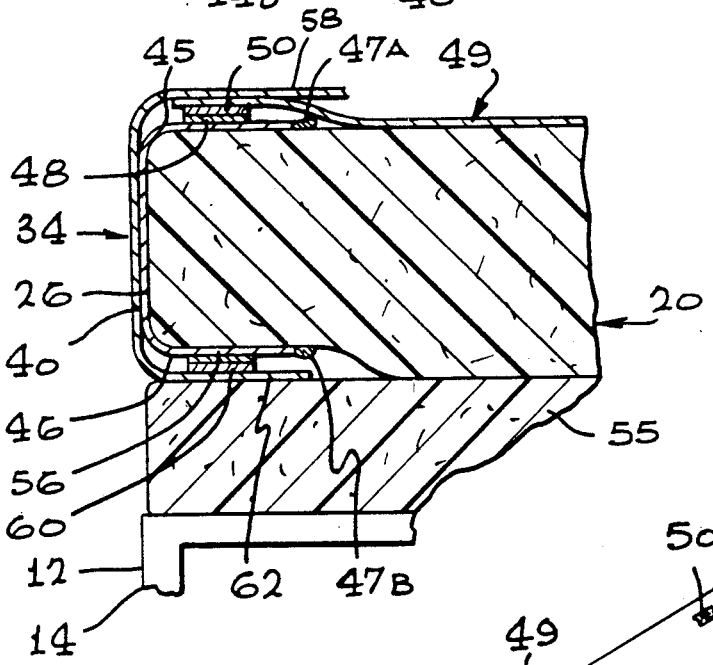

Illustrated in FIG. 5, is a partial cross-sectional view of the mattress and bed sheet assembly similar to that shown in FIG. 3, illustrating a system to attach a top sheet thereto.

Figure 6:
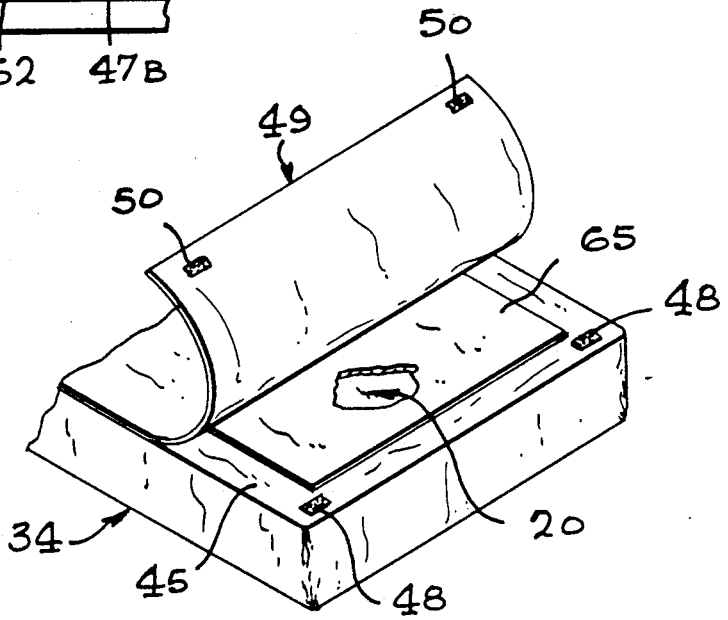

Illustrated in FIG. 6, is a partial perspective view of the mattress with bed sheet assembly mounted therein shown in FIG. 3, wherein the assembly incorporates an integral bed pad.

DESCRIPTION OF THE PREFERRED EMBODIMENT

Referring to FIGS. 1-3 it can be seen that a baby crib, generally indicated by numeral 10, is illustrated in a perspective view. The crib 10 is conventional in nature having a flat rectangular mattress mounting member 12 with legs 14. Mounted about the periphery of the member 12 is a frame 16 composed primarily of vertically bars 18. The bars 18 prevent a baby from falling out of the crib while allowing the baby to be viewed. Mounted within the crib 10 is a conventional mattress 20. The mattress 20 includes sides 22 and 24 and ends 26 and 28 and top and bottom surfaces 30 and 31 (bottom surface 31 is best seen in FIG. 3). Additionally, a "bumper" 32, a padded cloth insert attached to the bars is installed about and above the mattress to protect the baby's head. It can be readily seen that with the mattress 20 installed in the crib, it is extremely difficult to install either conventional or fitted sheets, particularly the bottom sheet. With a baby, the sheets may need changing several times a day requiring that the mattress be lifted upward at its corners or manhandled to its side to remove the wet sheets. Thus, changing the sheets becomes a difficult and unpleasant chore.

However, the present invention eliminates this problem. The bed sheet assembly, generally indicated by numeral 33, comprises a mattress peripheral edge cover 34 having side panels 36 and 38 and end panels 40 and 42 forming four vertical corners 44A, 44B, 44C and 44D. The cover 34 further includes top and bottom peripheral edge portions 45 and 46, respectively. Thus, the cover in cross-sectional is in the form of a "C" (best seen in FIG. 3). It can be seen that the cover 34 fits about the mattress 20 with the top and bottom edge portions, 45 and 46, contacting the top and bottom surfaces 30 and 31, respectively of the mattress. Typically, the inner ends of the edge portions 45 and 46 would incorporate elastic material members 47A and 47B, respectively, at least about the corners 44A and 44B, with the edge portions joined in a gathered fashion so that the cover can be stretched over the mattress upon installation. Mounted about the top edge portion 45 in proximity to the corners 44A and 44B are fastener means, and as illustrated are VELCRO hook and loop type fastener halves 48. 18 A sheet 49 is included having mating VELCRO hook and loop type fastener halves 50 at its corners such that when the cover 34 is installed on the mattress 20, the sheet 48 can be easily placed on the mattress such that the VELCRO hook and loop type fastener halves 48 and 50 are aligned and joined together. Referring to FIG. 4 it can be seen that a mattress pad 52 and/or waterproof sheet 54 can be installed easily under the edge portion 45 prior to installing the sheet 49. Thus, it can be seen that the sheet 49 and/or mattress pad 52 and/or waterproof pad 54 can be easily removed without moving the mattress 20.

Although the invention has been so far described in relationship to a baby crib it must be understood that the bed sheet assembly can be used with any type of bed. In fact, such is the case shown in FIG. 5. Here it can be seen that the mattress 20 is shown mounted on a conventional box spring 55. Assuming that end 26 of the mattress 20 is the foot of the bed it can be seen that VELCRO hook and loop type fastener halves 56 are mounted on the edge portion 46 at the corner 44A and 44D only (also, see FIG. 1). A top sheet 58 incorporates mating VELCRO hook and loop type halves 60 at the end 62 of the top sheet can be easily tucked under the mattress and joined to the cover 34 to hold it in place at the foot of the mattress.

Illustrated in FIG. 6, is an alternate configuration of the bed sheet assembly, wherein the cover 34 additionally includes a mattress pad 65 joined to the upper edge portion 45. This configuration is advantageous on large beds, wherein a separate bed pad 52 as shown in FIG. 4 would tend to dislodge. With such a configuration the incorporation of elastic member 47A to the upper edge portion 45 is unnecessary. It should also be noted that while the preferred fastening means are VELCRO hook and loop type fasteners other types of fasteners can be used. For example, buttonholes can be provided on the cover and buttons on the corners of the sheet. Furthermore, the mattress need not be rectangular, but could be square or even round. Thus, it can be seen that all the objects of the invention are met. Additionally, it should also be apparent that even a small child could change the sheets or a mother with one hand, while holding the baby, even if the bed were in the corner of a room. This is because the edge cover need not be removed in order to change the sheet, it is, in fact, seldom changed.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

Industrial Applicability

The invention has applicability to the bedding industry.

I claim:

1. A bed sheet assembly for a mattress comprising:

a fitted peripheral edge cover having a peripheral side panel for covering the side of the mattress, said panel having upper and lower edge portions extending inward, said upper and lower edge portions for extending continuously about the peripheral edges of the top and bottom surfaces of the mattress when installed thereon, said inner ends of said upper and lower edge portions incorporating elasticized material at least about a portion thereof so as to cause said upper and lower edge portions to gather together;

a sheet adapted to overlay said mattress; and means for removably attaching said sheet to said cover.

2. The assembly as set forth in claim 1, wherein the mattress is a rectangular shaped mattress and said cover includes sides and end panels for covering the sides and ends, respectfully, of the rectangular mattress, the adjacent ends of said sides and end panels joined to form vertical corners, said elasticized material extending at least about said corners of said edge portions.

3. The assembly as set forth in claim 2 wherein said elasticized material extends about the entire periphery of said upper and lower edge portions.

4. The assembly as set forth in claim 3, wherein said fastening means comprises mating hook and loop type fastener halves mounted on the upper edge portion of said cover in proximity to each corner and on the corners of the sheet such that when said sheet is placed on the mattress said hook and loop type fastener halves can be mated together releasible securing said sheet to said cover.

5. The assembly as set forth in claim 4, further including:

a top sheet; and second means for releasably attaching said top sheet to said lower edge portion of said cover.

6. The assembly as set forth in claim 5, wherein said second means comprises:

hook and loop type fastener halves mounted to said lower edge portion in proximity to one end of said corners of said cover; and hook and loop type fastener halves mounted on the corners of on end of said top sheet;

such that said top sheet can be mounted over said sheet and tucked under the mattress such that said Velcro fastener halves are mated.

7. The assembly as set forth in claim 1 or 2 or 4 or 5 or 6, wherein said cover includes an integral pad attached to said upper edge portion.

* * * * *